US006376056B1

(12) United States Patent
Krauter

(10) Patent No.: US 6,376,056 B1
(45) **Date of Patent: *Apr. 23, 2002**

(54) THERMO-TRANSFER RIBBON FOR LUMINESCENT LETTERS

(75) Inventor: Heinrich Krauter, Uetikon (CH)

(73) Assignee: Pelikan Produktions AG, Egg/ZH (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/169,567

(22) Filed: Oct. 9, 1998

Related U.S. Application Data

(63) Continuation-in-part of application No. 08/894,512, filed as application No. PCT/EP96/05688 on Dec. 18, 1996, now Pat. No. 6,033,767, which is a continuation-in-part of application No. 08/906,631, filed on Aug. 7, 1997, now Pat. No. 5,985,422.

(30) Foreign Application Priority Data

Aug. 8, 1996 (DE) ..... 196 32 111
Oct. 10, 1997 (DE) ..... 197 44 956

(51) Int. Cl.[7] ..... B41M 5/40

(52) U.S. Cl. ..... 428/212; 428/195; 428/484; 428/488.1; 428/488.4; 428/522; 428/690; 428/913; 428/914

(58) Field of Search ..... 428/484, 488.1, 428/488.4, 195, 212, 913, 914, 690, 522

(56) References Cited

U.S. PATENT DOCUMENTS 4,627,997 A 12/1986 Ide ..... 428/216
5,985,422 A * 11/1999 Krauter ..... 428/212
6,033,767 A * 3/2000 Krauter ..... 428/212

FOREIGN PATENT DOCUMENTS

DE 19548 401 A1 7/1997

* cited by examiner

*Primary Examiner*—Marie Yamnitzky
(74) *Attorney, Agent, or Firm*—Fay, Sharpe, Fagan, Minnich & McKee, LLP

(57) ABSTRACT

A thermo-transfer ribbon with a carrier, a first thermo-transferable layer formed on one side of the carrier and a second thermo-transferable layer formed on the first thermo-transferable layer, wherein (i) the first thermo-transferable layer contains a luminescent pigment, wax(es) having a melting point of approximately 70 to 110° C. and approximately 1–22% by weight of a polymer wax plasticizer having a glass temperature Tg of −30 to +70° C., (ii) the second thermo-transferable layer contains a non-luminescent pigment, a wax compatible polymer binder and approximately 5 to 30% by weight of wax and/or wax-like substance, (iii) the second thermo-transferable layer has a melting enthalpy DH of approximately 10 to 80 J/g and (iv) in the remission spectrum of the non-luminescent pigment in the wave length range of the light emitted by the luminescent pigment there is a remission maximum or an ascending flank of remission. The thermo-transfer ribbon furnishes print having high optical density without adversely affecting the luminescent power of the luminescent pigment. It is particularly suitable for high speed printing with edge-type print heads.

22 Claims, No Drawings

THERMO-TRANSFER RIBBON FOR LUMINESCENT LETTERS

This application is a continuation in part of U.S. Ser. No. 08/894,512, filed Nov. 5, 1997, now U.S. Pat. No. 6,033,767 which is a 371 of PCT/EP96/05688 filed Dec. 18, 1996 which is a CIP of U.S. Ser. No. 08/906,631, filed on Aug. 7, 1997 now U.S. Pat. No. 5,985,422.

The present invention relates to a thermo-transfer ribbon for luminescent letters or codings.

Modern sorting machines, as employed when sorting a multitude of objects, such as for example letters, react to luminescent coding which is not necessarily visible to the human eye. To that end, the pieces to be sorted are furnished, prior to the sorting process, with symbols which contain a luminescent substance. In growing measure, thermo-transfer (color) ribbons are used for said purpose, which have a layer of thermo-transfer color with a therein contained luminescent pigment. The luminescent transfer color, which is transferred to the substrate surface, is very thin and transparent for visual examination.

Luminescent colors have the property of absorbing ultraviolet light and visible light in the blue portion of the spectrum and to again radiate said absorbed portion at the lower end of the spectrum. From among the great number of organic compounds, which radiate visible light under the influence of short-wave rays, only such substances are suitable as luminescent pigments or luminogens which distinguish themselves in solid, non-dissolved state by intensive fluorescence. Those luminescent pigments which fluoresce in colors under day light, and which are employed as daylight fluorescent pigments, command the greatest technical interest. Soluble pigments of this type are for example rhodamine, eosine, brilliant sulfoflaven FF and the highly yellow-green fluorescent pyranine, also color pigments, for example 2,2-dihydroxy-alpha-naphthaldiazine and anthrapyrimidine.

Inasmuch as the pigments are organic in nature, it is necessary to dissolve them in an organic medium or carrier. Mostly tinted carrier substances are employed, for example pulverized polymerisates which are tinted with soluble pigments or finely distributed pigments. The type of material which corresponds to the requirements of a carrier or a matrix for the pigments is a transparent organic resin. By reacting acid polyester resins with basic pigments or by pulverizing solidified color substance solutions, one likewise obtains tinted carrier substances. Urea formaldehyde resins, acrylic resins and melamine resins are also used as carriers, onto which the pigments may be lacquered. Daylight fluorescent pigments are, in fact, organic plastic particles, which are tinted with fluorescent color substances. The physical structure of the pigment particles is mostly amorphous.

When luminescent material is precipitated on the surface of white paper, the whiteness of the paper serves as light reflector. The major portion of the incident light is reflected back by the paper through the imprinted luminescent material. The reflected light perceived by the observer contains both incident light as well as luminescent light.

If the luminescent material is transferred to the surface of a dark colored paper, a portion of the incident light, which has passed the luminescent layer, is absorbed by the paper. The amount of the light available from reflection is decreased. In addition, that percentage of light emitted by the luminescent color layer is being absorbed, which is radiated in the direction of the paper surface.

In order to compensate for the differences in intensity of luminescence, which are attributable to the type of carrier, DE-OS 30 42 526 proposes a fluorescent print ribbon, which is characterized by addition of a blocking material to the fluorescent pigment material, in order to block absorption of the incident light in the medium onto which the pigment and the blocking coating are transferred during printing. The blocking material is preferred as a second coating above the pigment coating. Both coatings are transferred in reverse order onto the substrate during the printing process. The blocking material contains reflecting metal particles or mother-of-pearl-type pigments.

DE-AS 12 22 725 discloses a transfer material for luminescent letters with a coating carrier of paper or foil with a luminescent color layer arranged thereon, whereby a pigmented, light-radiation reflecting coating is placed over the luminescent color layer, which participates in the writing process. The cover layer preferably contains titanium white and/or pressure-ground aluminum powder.

The known suggestions are aimed at avoiding absorption, in the substrate, of incident light passing through the luminescent layer, so that this portion is being reflected and once more passes through the luminescent color layer, in order to thus increase the overall excitation yield. It is, hereby, of drawback that the luminescent light perceived by the observer is always mixed with the reflected portion of incident light. The luminescent print-outs therefore always appear pale, i.e. they have low optical density.

If attempts are made to increase the optical density of the print-outs by adding a non-luminescent pigment to the layer of luminescent pigment, one notes that with an addition of extraneous pigments of more than 1%, fluorescence quality is significantly affected. With increasing addition amounts, there is growing impairment of the brilliance of the fluorescent pigments, the fluorescence power and color purity due to occurring interferences. Still higher addition amounts lead to almost total extinction of fluorescence. From the aspect of fluorescent output, an additional amount of 1% or less, however, would, only insignificantly increase the optical density.

The above described thermo-color ribbons are finding increasing entry in high speed printers, specifically in industry, whereby print heads are being employed of the so-called "Real-Edge" or "Corner" type. In these print heads a series of targetable heating points (dots) is arranged on a ceramic substrate, close to the edge or directly on the rim. The benefit of edge-type heads lies in shorter cooling-down times and correspondingly higher registration frequencies. Printing speeds of from 3 to 12" per second can be achieved with them. Prints obtained with high-speed printing are subject to special requirements with respect to print quality, i.e. excellent edge definition, dissolution and optical density. A specific application field is the imprinting of paper and plastic labels. With respect to the latter, high scratch resistance of prints is desirable.

The thermo-transfer ribbons for luminescent codes provided thus far by the state of the art do not satisfy the addressed requirements to the desired extent. The invention is therefore based on the object of providing a thermo-transfer color ribbon for luminescent codes, whereby print-outs of high optical density could be obtained without affecting the luminescence output of the luminescent pigment and irrespective of substrate to be imprinted, including satisfactory print quality at high printing speeds. The luminescent symbols transferred during the printing process shall have good adhesion and good scratch resistance, specifically on paper and plastic labels.

According to the invention, this object is solved by a thermo-transfer ribbon with a carrier, a first thermotransferable layer formed on one side of the carrier and a second thermo-transferable layer formed on the first thermo-transferable layer, whereby (i) the first thermo-transferable layer contains luminescent pigments, wax(es) having a melting point from approximately 70 to 110° C. and approximately 1 to 22% by weight of a polymer wax plasticizer with a glass temperature Tg of −30 to +70° C., (ii) the second thermo-transferable layer contains a non-luminescent pigment, a wax-compatible polymer binding agent and approximately 5 to 30% by weight of wax and/or wax-like substance, (iii) the second thermo-transferable layer has a melting enthalpy DH of approximately 10 to 80 J/g and (iv) there is, in the remission spectrum of the non-luminescent pigment in the wave length range of the light emitted by the luminescent pigment, a remission maximum or an ascending flank of remission.

In preferred specific embodiments, the second thermo-transferable layer contains approximately 5 to 40% by weight, specifically approximately 10 to 20% by weight of filler substances.

The non-luminescent pigment is a pigment whose remission is highly wave-dependent. The color impression of a non-luminescent pigment is produced as result of selective reflection of several segments of the visible white light spectrum. The non-reflected part is absorbed and converted into heat. An orange-red color reflects, for example, the orange-red part of light and absorbs all other colors of the spectrum. Good, non-luminescent pigments are capable of reflecting approximately 90% of the corresponding portion of the spectrum. White pigments, however, show non-selective high reflection over the entire visible spectrum.

The non-luminescent pigment to be employed according to the invention reflects only the light emitted by the luminescent pigment and the wave length portion of the not absorbed incident light, which lies at or near the (longest-wave) emission bands of the luminescent pigment. The obtained print-outs thus show substantially more contrast and improved optical density. Selection of the non-luminescent pigment permits, in addition, that the color shade of the print-out is varied within certain limits, without loss of brilliance, because of interference between the emitted light and the light remitted by the non-luminescent pigment.

For purposes of the invention, it is preferred that the luminescent pigment is a daylight fluorescent pigment and the non-luminescent pigment is a color pigment. The daylight fluorescent pigments are commercially available under the brand names Lumogens (BASF), Day-Glo® Colors, Goldfire-Colors, Fluorzink or Brillink-Glow Color. In view of targeted use in postage meter printers, the daylight fluorescent pigment preferably emits in the wave length range of orange to red, i.e. at approximately 580 to 620 nm (with an excitation energy of 254 nm). The preferred color pigment is hereby a red pigment, whereby this term is to be understood in its most comprehensive meaning.

In high-speed print, the thermal print head dwells only a very short time at a given location of the thermo-transfer ribbon. Since, on the other side, the print head output is limited, there is only very little energy available for softening the thermo-transferable layer. It was then discovered that in order to attain high print speeds, a thermo-transferable layer with low melting enthalpy can be employed to advantage. It has been shown, however, that layer compositions having low melting enthalpy in melted state show high adhesion to carrier materials, so that the result would be inadequate transfer to the accepting substrate during the printing process. The invention solves this problem by special layer composition of the first and second thermo-transferable layer.

The waxes employed in the first thermo-transferable layer follow the standard definitions for wax, with limitation of melting point to approximately 70 to 110° C. In the most comprehensive meaning of the term, this involves material which is solid to brittle hard, coarsely to finely crystalline, transparent to opaque, but not glass-like, which melts above 70° C., but is just slightly above the melting point relatively low viscous and not stringy. Waxes of this type can be categorized into hydrocarbon waxes (alkanes without functional groups) and waxes from long-chain organic compounds with functional groups (mainly ester and acid waxes). Among the hydrocarbon waxes are, aside from mineral wax, the solid hydrocarbons produced from crude oil and tar and also synthetic paraffins. Among the waxes with functional groups are all vegetable waxes including chemically modified waxes. Ester waxes consisting essentially of esters, which are formed from linear carbonic acid with approximately 18 to 34 C-atoms and approximately equally long linear alcohols. High percentages of free carbonic acid are represented in acid waxes. Waxes with functional groups are preferred. To be named among these are particularly ester waxes, for example on basis of mineral wax, partially saponified ester waxes, acid waxes and oxidized and esterified synthetic waxes. Named among the particularly preferred ester waxes are vegetable waxes, such as carnauba wax and candellila wax, including high-melting, closely-cut paraffins. Particularly preferred, within the scope of the invention, are waxes having a melting point from 70 to 105° C. Particularly preferred are the following: Carnauba wax, LG-wax BASF and Hoechst Wax E. Wax(es) preferably amount to 40–80% by weight of the first thermo-transferable layer.

The first thermo-transferable layer also contains approximately 1 to 22% by weight, preferably approximately 2 to 20% by weight and specifically approximately 4 to 10% by weight of polymer wax plasticizer. Said plasticizer causes the particularly prefered hard waxes, specifically in the form of ester waxes and high-melting closely cut paraffins to be plasticized and thus lose their brittleness and tendency to "splinter". They ensure good anchoring or adhesion of the separation layer to the carrier material. Ester waxes are very hard or brittle waxes, i.e. they can be pulverized in cold state. If these are mixed with the named polymer wax plasticizers, elastic products are created which can hardly be pulverized. The specified amount of polymer wax plasticizer is critical. Higher than specified quantities should be avoided, because otherwise there is insufficient release effect in relation to the carrier. Too low a quantity of polymer wax plasticizer results, among others, in that the brittle wax is inadequately plasticized and the layer shows no uniform separation behavior or leads to an inhomogeneous image, primarily in coherent color areas.

To be considered as wax plasticizers are polyesters, co-polyesters, polyvinylacetate, polystyroles with a glass temperature Tg of −30 to +70° C., preferably −20 to +10° C. Preferred among these are polyesters and co-polyesters. Preferably this involves linear saturated polyesters or co-polyesters with an average molecular weight of 1500 to 18000. The first thermotransferable layer usually has a melting enthalpy DH of approximately 150 to 210 J/g.

The second thermo-transferable layer has a melting enthalpy DH of approximately 10 to 80, specifically approximately 15 to 50 J/g. According to the state of the art, thermo-transfer color layers usually have a melting enthalpy DH in excess of 130 to 220 J/g. The term "Melting Enthalpy DH" signifies the amount of endothermal energy which is represented by the peak area which is enclosed in the thermal flow-temperature curve and the base line when taking DSC measurements in a temperature interval of 25 to 120° C. During the specified temperature interval, the layer composition of the second thermo-transferable layer need not necessarily melt completely, which is regularly the case if the layer contains dispersed insoluble constituents, like fillers.

Of significance is only that the composition of the layer in the specified temperature interval has at least one phase transfer during which it passes from solid state to a relatively low viscous state, and that said phase transfer generates a peak in the DSC calorigram which corresponds to the specified energy amount. When several peaks occur, adjustment must be made to the sum of the peak areas. In order to obtain sufficiently low melting enthalpy, particular importance must be assigned to the selection of the binding agent. The binding agent of the second thermo-transferable layer must, in addition, be wax-compatible so that the layer has sufficient adhesion relative to the first thermo-transferable layer. The term "wax-compatible" in this context means that this polymer is compatible with a liquid wax and during cooling of a solution or dispersion of the polymer in wax there will be no phase separation. Wax-compatible polymers according to the meaning of the invention distinguish themselves in that they are meltable below approximately 100° C. They are sticky in molten state. Suitable polymers are for example ethylene-vinylacetate-copolymers (EVA), ethylene-acrylic acid co-polymers, polyamides and ionomer resins. Preferred among these are ethylene acrylic acid co-polymers and EVA, specifically a polymer having a vinylacetate contents≧approx. 25% by weight. Particularly appropriate are types with at least approximately 33 or 40% by weight of vinylacetate.

The second thermo-transferable layer contains, in addition, approximately 5 to 30% by weight, specifically approximately 15 to 25% by weight of waxes and/or wax-like substances. The addition of waxes and/or wax-similar substances prevents conglutination of the ribbon in rolled-up state or adhesion of ribbon at the location of the accepting substrate where no symbol is to be transferred. Higher than specified amounts of wax must be avoided because the high melting enthalpy of the wax would result in too high a melting enthalpy of the entire formulation. It is true that a low addition of wax leads to low melting enthalpy, but will not prevent sticking to the degree desired. Suitable waxes for the second thermo-transferable layer are: close-cut paraffin waxes, ester waxes, acid waxes, micro-waxes and modified micro-waxes. Mineral waxes are not preferred. Close-cut paraffin waxes are particularly preferred. The enumerated waxes distinguish themselves in that softening point and melting point lie close together. During heating, at least 80% of the material should become fusible within a temperature interval of 10° C. The melting point of the waxes in the second thermo-transferable layer preferably lies at approximately 70 to 105° C.

The second thermo-transferable layer preferably receives, in addition, also filler substances (extenders) such as for example aluminum silicate, aluminum oxide, silica, talcum, calcium-carbonate, aluminum hydroxide, zinc oxide, silicic acid, kaolin, titanium dioxide etc. The extenders lighten the color (transparent layers) and, at the same time, the "sticking behavior" of the ribbon is favorably influenced.

Many other added substances may be incorporated into the second thermo-transferable layer. The layer of the thermo-transfer color preferably contains one or several resins having a melting point from 80 to 150° C. Suitable resins are for example: KW-resins, terpene phenol resins, modified colophony resins, coumarone-indene resins, maleic resins, alkyde resins, phenol resins, polyester resins, polyamide resins and/or phthalate resins. Among these, KW resins and poly-terpene resins are particularly preferred. The ratio of wax-compatible polymer to resin in the thermo-transfer color is preferably between 70:30 to 90:10 (weight/weight).

The viscosity of the second thermo-transferable layer must be sufficiently low, so that the color can be given off quickly and dot-accurately. It preferably has a viscosity of approximately 500 to 3000 mPas·s, measured at 140° C. in a Brookfield-Rotation-Viscosimeter. A range of 600 to 1500 mPa·s. is particularly desirable.

The polymer binding agent employed in the second thermo-ransferable layer is amorphous or in part crystalline and requires little energy for the melting process.

Following the printing process, separation occurs of the thermo-transfer ribbon from the acceptor, as long as the layer is still "liquid", in other words, is still in molten or softened state. This circumstance permits utilization of polymer-resin-bound colors, which, in turn ensure high sharpness of edge, good resolution and optical density. This is primarily of importance with real-edge print heads. The plastic-bound color layer warrants excellent scratch resistance of transferred print symbols on paper as well as on plastic labels.

The thicknesses of the thermo-ransferable layers are not critical. The first thermo-transferable layer preferably has a thickness of approximately 0.4 to 4 μm, specifically approximately 1 to 2 μm. Thickness of the second thermo-transferable layer preferably measures approximately 1 to 5 μm, specifically approximately 1 to 3 μm.

The type of substrate of the thermo-transfer ribbon according to the invention is likewise not crucial. Preferably it involves polyethylene-terephthalate foil (PETP) or condenser papers. Selection parameters are highest possible stress/strain values and thermal stability with low foil thicknesses. The PETP foils are obtainable in a thickness down to approximately 2.5 μm, condenser papers down to approximately 6 μm.

A beneficial improvement of the concept according to the invention—specifically with respect to achieving excellent print—is based on the teaching of EP-B-O 133 638. Accordingly, a layer is formed on the reverse side of the carrier, consisting of a wax or a wax-type material, specifically with a thickness of not more than 1 μm and particularly preferred in form of a molecularly developed layer up to 0.01 μm—with coating material in this case preferably consisting of paraffin, silicone, mineral waxes, specifically carnauba wax, bees wax, ozocerite and paraffin wax or synthetic waxes, specifically acid waxes, ester waxes, partially saponified ester waxes and polyethylene waxes, glycoles or poly-glycoles and/or tensides.

In certain instances it may be of benefit to incorporate additives that improve the properties of the ribbon. In such case a person skilled in the art will select, within the scope of expert considerations, that particular additive with which he intends to produce a certain effect.

The thermo-transfer ribbon can be produced in many ways using conventional application methods. This can be done, for example, by spraying or imprinting a solution under dispersion, either with water or an organic solvent as dispersion medium or a solvent, by application from the melt, which applies particularly with respect to the waxbound, first thermo-transferable layer, or also by application by means of a wiper in form of a watery suspension with a finely therein distributed coating material. For application of the release layer as well as the color layer, coating methods, such as reverse roll and/or engraving coating have proven particularly beneficial.

With respect to the practical realization of the present invention, the following basic conditions may be stated regarding application quantities of the individual layers:

Onto a carrier foil, specifically a polyester foil having a thickness of approximately 2 to 8 $\mu$m, specifically a thickness of approximately 4 to 5 $\mu$m, are applied, in succession: Coating mass for forming the first thermo-ransferable layer 0.5 to 4 g/m$^2$, preferably approximately 0.5 to 2 g/m$^2$, and coating mass for forming the second thermo-ransferable layer 1 to 5 g/m$^2$, preferably approximately 1 to 2 g/m$^2$. If required, an above mentioned reverse side coating is formed on the reverse side of the carrier having a thickness of approximately 0.01 to 0.2 g/m$^2$, specifically of approximately 0.05 to 0.1 g/m$^2$.

The thermo-transfer ribbon according to the invention is beneficially utilized in a corner-edge type printer, specifically in postage metering machines. It comes as a surprise that all kinds of paper, i.e. smooth as well as rough papers, can be used, providing excellent print quality. The layer of the second thermo-transfer paper seems to act hereby as "top coat" equalizing unevenness of the surface.

The invention is explained in more detail based on the following example:

EXAMPLE

The material according to the following recipe I is dispersed in a solution mixture of toluol/isopropyl alcohol (mixing ratio: 85:20) in order to form a dispersion, so that the solid matter component portion amounts to approximately 12% by weight. The first thermo-transfer color is applied in form of said dispersion with a coating thickness of 2 $\mu$m (2 g/m$^2$ relative to solid substance) by reverse roll printing onto a conventional polyester substrate having a thickness of 4.5 $\mu$m, and the liquid component portion of the applied dispersion is evaporated in a conventional drying channel.

| Composition of the first thermo-transferable layer (recipe I): | |
|---|---|
| Carnauba wax | 60 parts by weight |
| Paraffin wax | 20 parts by weight |
| Polyester resin (Dynapol S 1420) | 4 parts by weight |
| Luminescent Pigment (Dayglo Fire Orange) | 26 parts by weight |
| | 100 parts by weight |

The second thermo-transferable layer of the following Recipe II is applied in corresponding fashion onto the first thermo-transferable layer, whereby the ratio of toluol/isopropyl alcohol in the solution mixture is 30:70.

| Composition of the second thermo-transferable layer (recipe II): | |
|---|---|
| Paraffin wax | 15 parts by weight |
| EVA 40-55 (Ethylene-Vinyl-Acetate-Copolymer) | 50 parts by weight |
| Zonatac 85 Lite (Terpene Resin) | 7 parts by weight |

-continued

| Composition of the second thermo-transferable layer (recipe II): | |
|---|---|
| Pigment (Permanent Lacquer Red | 14 parts by weight |
| Silicate Filler (Transpafill) | 14 parts by weight |
| | 100 parts by weight |

What is claimed is:

1. Thermo-transfer ribbon with a carrier, a first thermo-transferable layer formed on one side of the carrier and a second thermo-transferable layer, formed on the first thermo-transferable layer, wherein i) the first thermo-transferable layer contains a luminescent pigment, wax(es) having a melting point of approximately 70 to 110° C. and approximately 1–22% by weight of a polymer wax plasticizer having a glass transition temperature Tg of −20 to +10° C., ii) the second thermo-transferable layer contains a non-luminescent pigment, a wax-compatible polymer binding agent and approximately 5 to 30% by weight of wax, iii) the second thermo-transferable layer has a melting enthalpy DH of approximately 10 to 80 J/g, and iv) in the remission spectrum of the non-luminescent pigment, in the wave length range of the light emitted by the luminescent pigment there is a remission maximum or an ascending flank of the remission.

2. Thermo-transfer ribbon according to claim 1, characterized in that the luminescent pigment is a daylight fluorescent pigment and the non-luminescent pigment a color pigment.

3. Thermo-transfer ribbon according to claim 2, characterized in that the daylight fluorescent pigment emits in the wave length range from orange to red and the color pigment is a red pigment.

4. Thermo-transfer ribbon according to claim 1, characterized in that the second thermo-transferable layer has a melting enthalpy DH of approximately 15 to 50 J/g.

5. Thermo-transfer ribbon according to claim 1, characterized in that the first thermo-transferable layer contains approximately 15 to 40% by weight of luminescent pigment.

6. Thermo-transfer ribbon according to claim 1, characterized in that the second thermo-transferable layer contains approximately 10 to 20% by weight of non-luminescent pigment.

7. Thermo-transfer ribbon according to claim 1, characterized in that the second thermo-transferable layer contains, in addition, approximately 5 to 40% by weight of filler substances.

8. Thermo-transfer ribbon according to claim 1, characterized in that the wax in the first thermo-transferable layer is an ester wax.

9. Thermo-transfer ribbon according to claim 1, characterized in that the first thermo-transferable layer contains 4 to 10% by weight of polymer wax plasticizer.

10. Thermo-transfer ribbon according to claim 1, characterized in that the polymer wax plasticizer of the first thermo-transferable layer is a polyester and/or co-polyester resin.

11. Thermo-transfer ribbon according to claim 1, characterized in that the wax-compatible binder in the second thermo-transferable layer is an ethylene-vinyl-acetate-copolymer, ethylene acrylic acid copolymer, polyamide and/or ionomer resin.

12. Thermo-transfer ribbon according to claim 1, characterized in that the wax-compatible polymer binder of the second thermo-transferable layer is amorphous or in part crystalline.

13. Thermo-transfer ribbon according to claim 1, characterized in that the second thermo-transferable layer contains, in addition, resins in form of hydro-carbon resins or polyterpene resins.

14. Thermo-transfer ribbon according to claim 1, characterized in that the second thermo-transferable layer has a viscosity of approximately 500 to 3000 mPa·s., measured at 140° C. in a Brookfield-Rotation-viscosimeter.

15. Thermo-transfer ribbon according to claim 1, characterized in that the thickness of the first thermo-transferable layer is 0.5 to 4 $\mu$m.

16. Thermo-transfer ribbon according to claim 1, characterized in that the thickness of the second thermo-transferable layer is 1 to 5 $\mu$m.

17. Thermo-transfer ribbon according to claim 1, characterized in that the carrier is a polyethylene-terephthalate foil.

18. Thermo-transfer ribbon according to claim 1, further comprising a reverse side coating having a thickness of not more than approximately 1 $\mu$m.

19. A high speed printer including the thermo-transfer ribbon according to claim 1.

20. Thermo-transfer ribbon according to claim 1, characterized in that the second thermo-transferable layer has a viscosity of approximately 600 to 1500 mPa·s., measured at 140° C. in a Brookfield-Rotation-viscosimeter.

21. Thermo-transfer ribbon according to claim 1, characterized in that the thickness of the first thermo-transferable layer is 1 to 2 $\mu$m.

22. Thermo-transfer ribbon according to claim 1, characterized in that the thickness of the second thermo-transferable layer is 1 to 3 $\mu$m.

* * * * *